United States Patent [19]

Ewing

[11] Patent Number: 4,751,752

[45] Date of Patent: Jun. 21, 1988

[54] DRAIN HOLE STRAINER PLUG FOR ICE COOLED UNITS

[75] Inventor: Leonard G. Ewing, New Braunfels, Tex.

[73] Assignee: Lancer Corporation, San Antonio, Tex.

[21] Appl. No.: 945,307

[22] Filed: Dec. 22, 1986

[51] Int. Cl.[4] ..... A47K 1/14

[52] U.S. Cl. ..... 4/287; 4/286; 4/292; 4/295

[58] Field of Search ..... 4/286–295

[56] References Cited

U.S. PATENT DOCUMENTS

| | | | |
|---|---|---|---|
| 923,270 | 6/1909 | Johnson | 4/286 |
| 3,671,982 | 6/1972 | Saylas | 4/295 |
| 4,067,072 | 1/1978 | Izzi | 4/292 X |

FOREIGN PATENT DOCUMENTS

| | | | |
|---|---|---|---|
| 394060 | 11/1965 | Switzerland | 4/286 |

*Primary Examiner*—Henry K. Artis

*Attorney, Agent, or Firm*—Cox & Smith Inc.

[57] ABSTRACT

A drainhole strainer plug comprising a raised central grating member, a concentric recessed trickle-down member, and a plug.

6 Claims, 1 Drawing Sheet

DRAIN HOLE STRAINER PLUG FOR ICE COOLED UNITS

BACKGROUND OF THE INVENTION

The present invention relates to a drain hole strainer plug for ice storage and cooling apparatus. More particularly, the invention relates to a drain hole strainer plug capable of preventing ice clogging in a drain hole, yet maximizing water drainage from the drain hole.

This type of unit is used primarily in association with drink dispensing apparatus in which a cold plate having conduits embedded therein is positioned in the bottom of the ice storage container. The ice serves the two fold purpose of maintaining the cold plate at a temperature less than 40° F. and also providing ice for the drinks that are dispensed from the apparatus.

The conduits embedded in the cold plate carry soft drink syrups and carbonated mixing water to the dispensing nozzle. It is imperative that the temperature of the dispensed drink be maintained below 40° F. to eliminate excessive foaming of the drink which is caused by the release of carbon dioxide at temperatures above 40° F.

As drinks are dispensed and ice is removed from the storage unit, the ice in the unit begins to melt. If pieces of ice clog the drain hole, melted water will collect on top of the cold plate and will act as an insulating layer between the plate and the ice above it. This allows the temperature of the liquids flowing through the conduits in the plate to rise above 40° F.

Traditionally, drain hole strainer plugs for ice storage and cooling units have been either a simple flat round grating construction, or a unitary plug having a side-slot mechanism to permit drainage of melted water around the plug. Either of the traditional types of drain plugs has the problem of ice glazing over the drain and clogging up the holes or the side slots so that draingage is precluded until enough water builds up to finally melt the clogged ice. In the meantime of course, the cold plate has warmed up. In a typical ice cooled unit, a constant process of thawing and draining takes place, and as the thawing and draining process continues, the temperature in the ice cooled unit is continuously raised above 40°.

It is an object of the present invention to provide a drain hole strainer plug for ice cooled units which will prohibit the glazing over of the water outlets by clogged ice particles and permit continuous drainage of melted water.

It is another object of the present invention to provide a drain hole strainer plug which can be utilized in drain apertures having varying sizes and irregularities of shape.

Another object of the present invention is to provide a drain hole strainer plug which may be easily installed in an ice cooled unit.

A further object of the present invention is to provide a drain hole strainer plug designed to prevent over-insertion or jamming in a drain aperture, such that the drain hole strainer plug can be removed for ease in cleaning.

A further object of the present invention is to provide a drain hole strainer plug which can be retrofitted for use in available ice cooled cold plate units.

Yet another object of the present invention is to provide a drain hole strainer plug which when in use does not interfere with scoops or agitators.

A further object of the present invention is to provide a drain hole strainer plug which can be produced at low cost.

A further object of the present invention is to provide a drain hole strainer plug which increases water drainage from a cold unit and consequently decreases output syrup temperature in a cold unit.

Yet another object of the present invention is to provide a drain hole strainer plug having means for removal for easy cleaning.

Other objects, features and advantages of the invention will become evident in light of the following detailed description, viewed in conjunction with the referenced drawings, of a preferred exemplary drain hole strainer plug according to the invention. The foregoing and following description of the invention is for exemplary purposes only. The true spirit and scope of the invention is set forth in the appended claims.

SUMMARY OF THE INVENTION

These and other objects of the present invention are achieved by providing a drainhole strainer plug having a raised central grating portion, a concentric recessed trickle-down portion, and a plug portion, and a side slot for easy adjustment to irregularities and size differences of drain holes in cold plates. The drain hole strainer plug comprises means for plugging the drain hole, and means for preventing coagulation of ice around the drain hole, and means for draining melted ice water through the plugging means.

BRIEF DESCRIPTION OF THE DRAWINGS

FIG. 4 is a cross-sectional view taken along line 4—4 of FIG. 1.

DETAILED DESCRIPTION OF THE DRAWINGS

Figure 1:
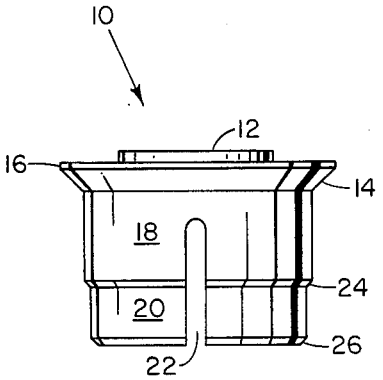
FIG. 1 is a side veiw of the apparatus of the present invention.

FIG. 1 shows the apparatus of the present invention designated generally at 10 as it appears when viewed from the side. Flange 12 of drain hole strainer plug 10 extends above flattened plug 16. Plug 16 has a beveled under side 14. Beveled underside 14 permits drainhole plug 10 to fit tightly in a drainhole (not shown).

Base 19 extends downwardly from plug 16. Base 19 has a top section 18 and bottom section 20 of smaller diameter than top section 18. A longitudinal slot 22 is received within base 19 and extends substantially along the longitudinal axis of and through base 19.

Transitional area 24 and bottom edge 26 of base 19 are smoothly beveled to permit easy insertion of the strainer plug into a chosen drain hole.

Figure 2:
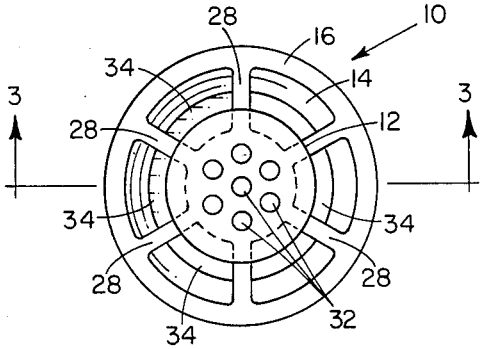
FIG. 2 is a top view of the apparatus of the present invention.
Figure 3:
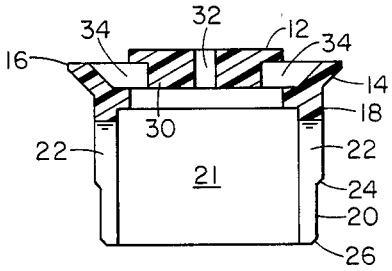

Referring to FIG. 2 the drain hole strainer plug is shown from the top. Flange 12 is integral with center drain 30. Flange 12 can be grasped while inserting or removing drainhole plug 10 from a drainhole (not shown). Spokes 28 extend between center drain 30 and flattened plug 16. Round apertures 32 extend through center drain 30, permitting liquid to flow through round apertures 32 into interior cylindrical space 21, shown in cross-sectional FIG. 4. Liquid can also flow into spaces 34 between spokes 28, and thus downward into interior cylindrical space 21.

Referring to FIGS. 1, 2 and 4, the drain hole strainer plug 10 according to the present invention operates as follows. The base 19 is centrally disposed within a drain hole in an ice cooled unit. Ice is placed within the unit, over and around the top of drain hole strainer plug 10. As the ice begins to melt it has a tendency to coagulate together around the strainer plug. Flange 12 prevents ice from glazing over the top of drain hole strainer plug 10 in a sheet, by extending upward sufficiently to create a space for melted cold water to trickle down and through spaces 34 between spokes 28.

Ice which clusters atop center drain 30 gradually melts and the water trickles through round apertures 32. The two levels of flange 12 and flattened plug 16 prevent ice from glazing over the drain by providing drainage at both levels.

Flange 12 also permits easy removal and reinsertion of drain hole strainer plug 12 for cleaning when desired. Longitudinal slot 22 within base 19 is compressible, so that drain hole strainer plug 10 can fit into various sized or irregularly sized drain holes in ice cooled units. In a present preferred embodiment the drain hole plug is formed of an extruded plastic material, although it could be made of other plastics, metal, or other suitable materials known to those of ordinary skill in the art.

Although the invention has been described in conjunction with the foregoing specific embodiment, other alternatives, variations, and modifications will be apparent to those of ordinary skill in the art. Those alternatives, variations, and modifications are intended to fall within the spirit and scope of the appended claims.

I claim:

1. A strainer plug for ice storage and cooling apparatus, adaptable for plugging a drain hole and for straining liquid so the liquid drains through the drain hole, comprising:

an annularly shaped plug adaptable for plugging the drain hole;

an axial strainer oriented coaxially with said annularly shaped plug; and a plurality of elongated support members extending approximately horizontally from said annularly shaped plug to said axial strainer;

said axial strainer further comprises a radially extending flange at a position which is elevated relative to the upper extremeties of said plug for preventing glazing of ice.

2. The strainer plug as in claim 1, wherein:

a space of an annular nature for enabling draining of material around said axial strainer is formed between said axial strainer and inner surfaces of said plug;

said annularly shaped plug further comprises an internal shoulder positioned beneath said axial strainer and beneath said elongated members for enabling a trickle-down beneath a plurality of openings allowing drainage through the drain hole, which openings are defined in part by the surfaces of said elongated support members in conjunction with the outer circumference of said axial strainer and the internal circumferential surface of said annularly shaped plug.

3. The strainer plug of claim 2 wherein said elongated support members further comprise spokes of an approximately radial orientation relative to said axial strainer.

4. The strainer plug of claim 1 wherein:

said annularly shaped plug has a slot extending longitudinally downward for enabling installation in and removal from the drain hole; and the slot of said annularly shaped plug is open ended, having an open end through the lower-most portion of said plug.

5. The strainer plug of claim 3, wherein:

said annularly shaped plug further comprises a first and a second annularly cylindrical sections, for enabling plugging of a plurality of drain holes having relatively differentially sized circumferences;

said first annularly cylindrical section has an outer diameter greater than the outer diameter of said second annularly cylindrical section;

said first and second annularly cylindrical sections are integrally formed with said plug, said second annularly cylindrical section being located lower than said first annularly cylindrical section;

said annularly shaped plug has a slot extending longitudinally downward for enabling installation in and removal from the drain hole; and the slot of said annularly shaped plug is open ended, having an open end through the lower-most portion of said plug.

6. The strainer plug of claim 5, wherein the annularly shaped plug further comprises a bevel providing a frusto-conically shaped connecting surface between the respective outer surfaces of said first and second annularly cylindrical sections.

* * * * *